United States Patent [19]

Thomas

[11] Patent Number: 4,792,659

[45] Date of Patent: Dec. 20, 1988

[54] GARAGE DOOR OPENER HEATER

[76] Inventor: Paul H. Thomas, 5930 Richard Dr., NW., Warren, Ohio 44483

[21] Appl. No.: 52,916

[22] Filed: May 22, 1987

[51] Int. Cl.[4] ..... H05B 3/56

[52] U.S. Cl. ..... 219/201; 16/DIG. 1; 49/199; 219/213; 219/535

[58] Field of Search ..... 219/200, 201, 213, 209, 219/218, 535, 528; 16/DIG. 1, DIG. 7; 49/199, 200

[56] References Cited

U.S. PATENT DOCUMENTS

| | | | |
|---|---|---|---|
| 1,833,066 | 11/1931 | Bradfish | 219/535 |
| 2,703,236 | 3/1955 | Verdier | 49/199 |
| 2,731,804 | 1/1956 | Grubbs | 219/218 |
| 2,858,408 | 10/1958 | Barroero | 219/218 |
| 3,064,110 | 11/1962 | Vogler | 219/213 |
| 3,074,096 | 1/1963 | Van Hess | 219/347 |
| 3,207,887 | 9/1965 | Drugmand | 219/535 |
| 3,462,885 | 8/1969 | Miller | 219/218 |
| 3,697,723 | 10/1972 | Winsler | 219/218 |
| 3,909,980 | 10/1975 | Courtney | 49/199 |
| 4,163,144 | 7/1979 | Reynier | 219/368 |

*Primary Examiner*—E. A. Goldberg
*Assistant Examiner*—Teresa J. Walberg
*Attorney, Agent, or Firm*—Harpman & Harpman

[57] ABSTRACT

A garage door opener heater for use on garage doors to heat the drive track of the opener during cold weather to prevent binding and restricted movement of the track when the lubricates within the track solidify at cold temperatures.

5 Claims, 1 Drawing Sheet

GARAGE DOOR OPENER HEATER

BACKGROUND OF THE INVENTION

1. Technical Field

This invention relates to automatic garage door openers that have an elongated exposed drive track. Most garages are unheated and during cold weather, the lubricates used on the drive track stiffen causing increased frictional resistance and interrupting smooth garage door opening.

2. Description of Prior Art

Prior art devices of this type are not known. The closest examples found are directed towards window sill heaters and entry door heaters, see for example U.S. Pat. Nos. 3,064,110 and 4,163,144.

In U.S. Pat. No. 3,064,110 a heated frame element is disclosed having a strip heating element positioned within an elongated enclosure next to the exposed bottom of a glass pane. A secondary heating strip is mounted under the glass pane with both heating strips powered via a switch from a central power source.

U.S. Pat. No. 4,163,144 discloses a heated door that has a hollow core filled with a plurality of strip heaters to draw in cold air through the bottom opening and exit heated air out the top of the door.

SUMMARY OF THE INVENTION

A garage door opener heater to provide auxiliary heat to the garage door openers track for ease of operation in cold weather. The garage door opener heater maintains a constant heated environment around the track by use of a light weight frame and intrical self-contained automatic heating source.

DESCRIPTION OF THE PREFERRED EMBODIMENT

Figure 1:
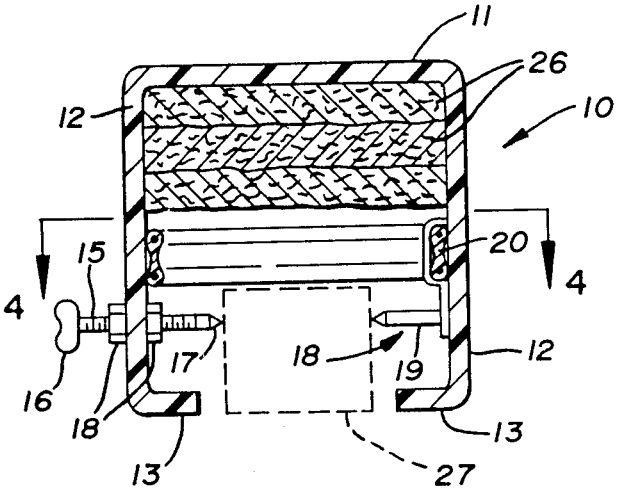
FIG. 1 is a cross-sectional view on lines 1—1 of FIG. 2.
Figure 2:
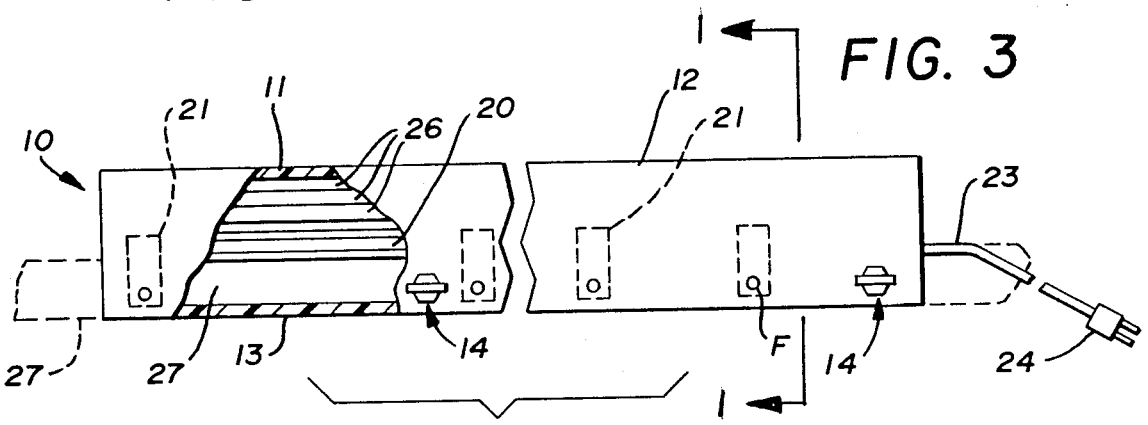
FIG. 2 is a side plane view of the garage door track heater.
Figure 4:
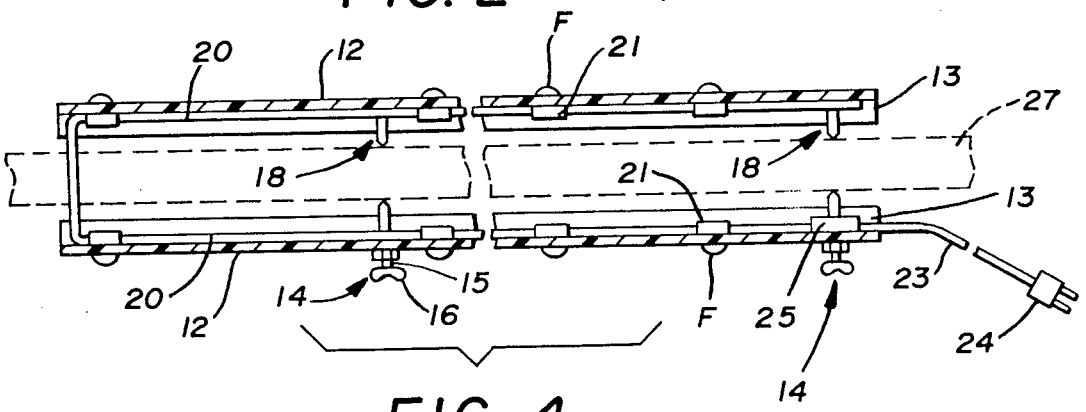
FIG. 4 is a top sectional view on lines 4—4 of FIG. 1.

A garage door opener heater can be seen in FIGS. 1, 2 and 4 of the drawings comprising an elongated channel enclosure 10 having a top portion 11, oppositely disposed wall portions 12 each of which has a right angularly inturned lip 13 extending from their free edges.

A plurality of adjustable support pins 14 are positioned in spaced longitudinal relation to one another along each of said walls 12.

Each of said adjustable support pins 14 are comprised of a threaded shaft 15 with a thumb engagement end portion 16 with a oppositely positioned pointed end portion 17. The threaded shaft 15 extends through an aperture in said walls 12 and has a pair of locking nuts 18 threadably secured thereon positioned on either side of said apertured wall 12 locking the threaded shaft 15 to said wall 12.

An alternate support pin configuration 18 can be used on one of said side walls 12 opposite said adjustable support pins 14 and comprises a fixed pointed shaft 19 extending outwardly from said side wall a distance greater than said lip 13.

Figure 3:
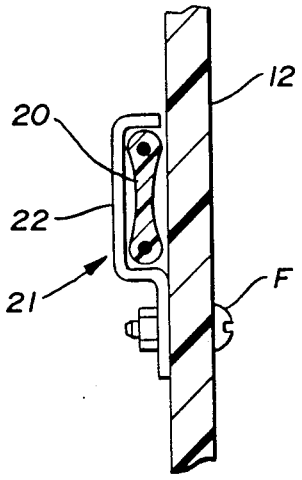
FIG. 3 is an enlarged cross-sectional view of a portion of the track heater.

A resistant heating tape 20 is positioned inside the elongated channel 10 and held in place against the inner sides of said walls 12 by a plurality of spaced clips 21 secured by fasteners F therethrough as best seen in FIG. 3 of the drawings. The clips 21 have an offset upstanding cable engagement portion 22 that forms an inverted vertically aligned U against said wall 12 securing said resistant heating tape 20 against the side wall 12. The resistant heating tape 20 is connected to a power source via a power lead 23 and a plug 24. A thermostatic switch 25 is positioned between the power source and the resistant heating tape 20 and will control same activating the heating tape 20 when the temperature drops below a predetermined range.

Referring now to FIG. 1 of the drawings, multiple layers of insulating material 26 are shown positioned inside said elongated channel enclosure 12 abutting the inside of its top portion 11 and extending from side wall 13 to side wall 13.

In operation the garage door opener heater is secured over and onto a opener track 27 (shown in dotted lines in FIGS. 1, 2 and 3 of the drawings) by its adjustable support pins 14. The resistant heating tape 20 is plugged into a power outlet (not shown) and the thermostatic switch 25 activates at a predetermined temperature energizing the resistant heating tape 20 warming the interior of the elongated channel enclosure 10 heating the opener track 27 within.

It will be apparent from the above description that with utilization of the garage door opener heating device the drive track of the garage door opener can be maintained at a operating temperature even during the coldest months since the track and the heater and the opener are all within an enclosed space and accordingly are not subject to vast temperature extremes which would normally be experienced in the outside environment.

Thus, it will be seen that a new and novel garage door opener heater has been illustrated and described and it will be apparent to those skilled in the art that various changes and modifications may be made therein without departing from the spirit of the invention.

Therefore I claim:

1. A garage door opener heater comprising an elongated channel enclosure, said channel enclosure comprising a top portion, oppositely disposed wall portions, and inturned lips extending from free edges of said oppositely disposed walls, a heating strip within said channel enclosure, means for connecting said heating strip to a power source, means for securing said heating strip in abutting relation on said oppositely disposed walls, a band of insulation in said elongated channel enclosure abutting said top portion and spaced in relation to said heating strip, means on said elongated channel for securing same to a garage door opener drive track and means for isolating the interior of said elongated channel enclosure around said garage door drive track.

2. A garage door opener heater of claim 1 wherein said means for connecting said heating strip to a power source comprises a power plug.

3. A garage door opener heater of claim 1 wherein said means for securing the heating strip to said elongated channel enclosure comprises a plurality of longitudinally spaced clips secured to said oppositely disposed side walls.

4. The garage door opener heater of claim 1 wherein said means for isolating the interior of the channel enclosure comprises inturned lips extending from the free ends of said oppositely disposed walls.

5. The garage door opener heater of claim 1 wherein said means on said elongated channel for securing same to a garage door opener drive track comprises adjustable support pins and fixed support pins secured to said oppositely disposed walls in transverse aligned relation to one another.

* * * * *